US007038383B2

(12) United States Patent
Butler et al.

(10) Patent No.: US 7,038,383 B2
(45) Date of Patent: May 2, 2006

(54) IGNITION AID FOR HIGH INTENSITY DISCHARGE LAMP

(75) Inventors: Scott J. Butler, North Oxford, MA (US); Arlene Hecker, Beverly, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/711,582

(22) Filed: Sep. 27, 2004

(65) Prior Publication Data

US 2006/0066241 A1 Mar. 30, 2006

(51) Int. Cl.
*H01J 17/30* (2006.01)

(52) U.S. Cl. ..... 313/595; 315/330

(58) Field of Classification Search ..... 315/330, 315/335; 313/567, 594, 601, 607, 623–624, 313/234, 595; 445/26, 66
See application file for complete search history.

(56) References Cited

U.S. PATENT DOCUMENTS

| | | | | |
|---|---|---|---|---|
| RE32,626 | E | 3/1988 | Yoshizawa et al. | 315/39 |
| 4,855,643 | A | 8/1989 | White | 313/553 |
| 5,541,480 | A * | 7/1996 | Renardus et al. | 313/635 |
| 5,757,137 | A | 5/1998 | Zhu | 315/73 |
| 6,222,320 | B1 | 4/2001 | Stockwald | 315/48 |
| 6,429,588 | B1 | 8/2002 | Guenther et al. | 313/594 |
| 6,456,005 | B1 | 9/2002 | Panchula et al. | 313/567 |
| 6,538,377 | B1 * | 3/2003 | Scott et al. | 313/567 |
| 6,563,265 | B1 * | 5/2003 | Sivaraman et al. | 313/567 |
| 6,628,079 | B1 | 9/2003 | Golkowski et al. | 315/39.51 |
| 6,661,171 | B1 | 12/2003 | Hecker | 313/594 |
| 6,674,239 | B1 | 1/2004 | Westemeyer et al. | 313/594 |
| 2003/0006705 | A1 | 1/2003 | Alderman et al. | 313/607 |

* cited by examiner

*Primary Examiner*—Thuy Vinh Tran
(74) *Attorney, Agent, or Firm*—Robert F. Clark

(57) ABSTRACT

An arc tube for a high intensity discharge lamp comprising a translucent body defining a discharge space and including spaced-apart electrodes; an arc generating and sustaining medium within the discharge space; and a starting aid contained within the discharge space, the starting aid comprising an electrically conductive stripe formed from a mixture of an electrically conductive material and the high temperature material.

7 Claims, 1 Drawing Sheet

IGNITION AID FOR HIGH INTENSITY DISCHARGE LAMP

TECHNICAL FIELD

This invention relates to high intensity discharge lamps and more particularly to starting aids for such lamps.

BACKGROUND OF THE INVENTION

High intensity discharge (HID) lamps typically require the application of a starting voltage or ignition voltage that is substantially higher than the operating voltage of the lamp. This starting voltage must provide a sufficiently higher electric field, such that, in the presence of an avalanche-initiating electron, breakdown will occur. It is well known to those skilled in the art that igniting HID lamps can be difficult, especially in lamps using high buffer gas pressures, in mercury-free lamps or in re-start situations after a lamp has recently been extinguished.

Many attempts have been made to improve the starting of HID lamps. For example, some ignition aids improve the starting performance by assuring the presence of an avalanche-initiating electron. Specifically, the use of UV enhancers and Krypton-85 containing buffer gases is well known. Other methods and devices are intended to enhance the local electric field in the region between the electrodes (or in the discharge volume for electrodeless lamps). Another method of aiding the initiation of a discharge involves increasing the electric field at a given externally applied voltage. It is to the latter category that the instant invention pertains.

Typically, such field enhancement is accomplished by the addition of an electrically conductive member such as a wire or metallized stripe, which reduces the effective arc gap between the electrodes, thus leading to a lower breakdown voltage. The conductor can be floating, as in the case of high pressure sodium lamps, (see, for example, U.S. Pat. No. 6,661,171), or the conductor can be electrically coupled to one of the electrodes. Connection to one of the electrodes introduces an undesirable influence on sodium migration in the case of metal halide or sodium lamps, so a bimetal switch typically is employed to disconnect the starting aid from the electrode as the lamp heats up.

In electrodeless lamps, it has been suggested to embed a conductor into the quartz envelope to provide field enhancement (see, for example, U.S. Re32,626). The deposition of a matrix coating of conductive and/or semi-conductive fibers has also been suggested to facilitate starting. The deposition can be internal or external and, if internal, it is suggested that the fibers be coated with a sol gel-deposited silica coating to protect the fibers from the plasma environment (see U.S. Pat. No. 6,628,079).

While the above methods have had success in the various large lamps currently in use, it would be an advance in the art if a reliable starting aid could be supplied for small, ceramic HID lamps.

SUMMARY OF THE INVENTION

It is, therefore, an object of the invention to obviate the disadvantages of the prior art.

It is another object of the invention to enhance the operation of ceramic HID lamps.

It is yet another object of the invention to provide a simple and economical method of enhancing the operation of ceramic HID lamps.

These objects are accomplished, in one aspect of the invention, by an arc tube for a high intensity discharge lamp comprising a translucent body defining a discharge space and including spaced-apart electrodes; an arc generating and sustaining medium within the discharge space; and a starting aid contained within the discharge space, the starting aid comprising an electrically conductive stripe of a cermet consisting essentially of W and $Al_2O_3$.

A method of making a body for an arc tube for a high intensity discharge lamp comprises forming at least a part of said body from a first material; pre-sintering said at least a part of said body; applying a stripe of a second material inside said body, said second material comprising a mixture of an electrically conductive material, a powdered form of said first material, and an evaporative carrier; drying said body in air to remove said evaporative carrier; inserting pre-sintered endcaps into said ceramic arc tube body to form an assembly; and sintering said assembly.

After the sintering operation the assembly can be filled with an arc generating and sustaining medium; and the electrodes can be inserted and sealed therein.

In a preferred embodiment of the method, the arc tube body is formed of a first material and the starting aid stripe comprises a cermet that is a mixture of tungsten (W) and a powdered form of the first material, together with a removable binder.

The W stripe poses no danger to materials within the discharge space since the electrodes themselves normally are made from tungsten and since the second portion of the mixture consists of the same material as the arc tube body it, too, insures no interference with the operation of the arc tube.

The cermet lends itself to many forms for application and results in a simple and inexpensive method with many advantages in a commercial environment.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
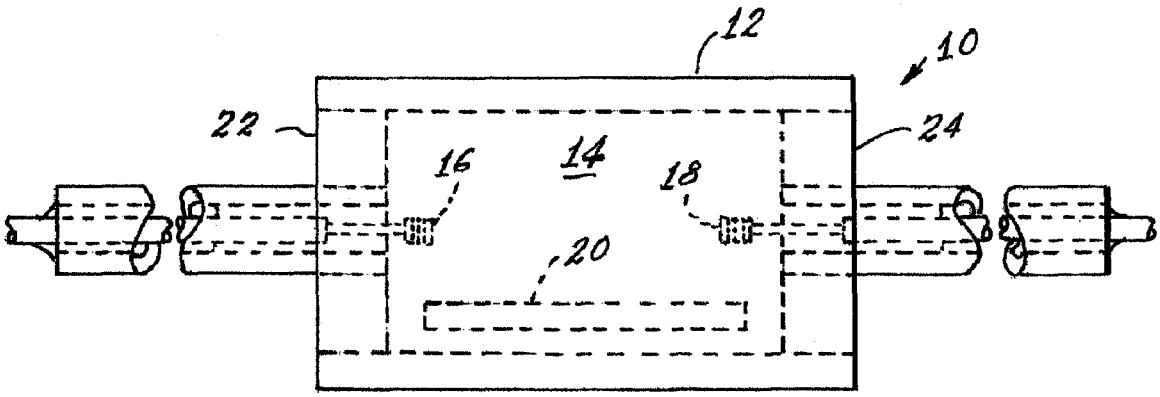
FIG. 1 is an elevational view of an arc tube in accordance with an aspect of the invention.
Figure 2:
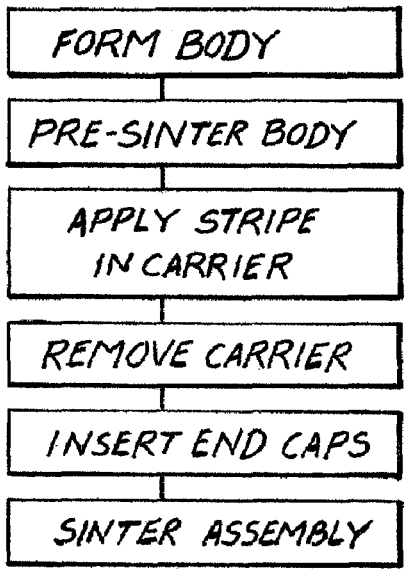
FIG. 2 is a flow diagram of a method of the invention.

Referring now to the drawings with greater particularity, there is shown in FIG. 1 an arc tube 10 for a high intensity discharge lamp. The arc tube 10 has a translucent body 12 formed from a high temperature material such as polycrystalline alumina (PCA). Other high temperature materials such as AlON, AlN or quartz could also be utilized. As shown the body 12 is cylindrical, includes a discharge space 14 and is closed by endcaps 22, 24 containing electrodes 16, 18. Other configurations for the body 12 can be employed, such as one known as the bulgy, which has a substantially elliptical shape.

The arc tube is filled with an arc generating and sustaining medium, as is conventional.

A starting aid 20 in the form of a stripe of material is positioned on an internal surface of the body 12. In a preferred embodiment of the invention the starting aid comprises a cermet of tungsten and powdered alumina.

Starting aids employing conductive stripes are known as floating, capacitively coupled starting aids. Such starting aids will charge to approximately ½ of the potential between the two electrodes. Therefore, the voltage applied between the starting aid and either electrode reaches a maximum value of ½ the applied starting voltage. When the starting aid is on the exterior of the arc tube, the voltage, and hence the electric field is divided between the thickness of the arc tube wall and the gas within the arc tube (essentially, a capacitive voltage divider). With the starting aid placed on the inside surface of the arc tube body, the voltage drop across the insulating arc tube is eliminated and the electric field near the electrode can be further enhanced.

The placement of the conductive starting aid on the inner surface of the arc tube should also facilitate improved streamer propagation from one electrode to the other, especially for a hot re-light.

As noted above the preferred material for the conductive stripe is a cermet comprised of tungsten (a material compatible with the environment within the body) and a powdered form of the material making up the body 12. Thus, when the body 12 is formed from PCA the cermet will comprise a mixture of tungsten and powdered alumina. A preferred mixture comprises 60 volume % tungsten and 40 volume % alumina in a liquid carrier comprised of alcohol and cellulose. The exact amount of the carrier will depend upon the method used to place the stripe inside the body.

The method of making the body 12 containing an internal conductive stripe 20 for an arc tube 10 comprises first forming the body 12 of a first material. The body 12 is preferably a ceramic and can be formed by any suitable method such as slip casting or die pressing to form a green part. The green part is then thermally treated to form a bisque fired part. The thermal treatment can be conducted by heating the green part in air from room temperature to a maximum temperature of about 850–1350° C. over 2 to 16 hours, holding the maximum temperature for about 1 to 3 hours and then cooling the part. The stripe 20, comprised of a mixture of a second material that is electrically conductive and a powdered form of the first material carried in a removal binder or carrier is then applied to the internal surface, for example by painting. Alternatively, the stripe can be applied automatically with an ink dispenser through a pen tip or with a syringe. The viscosity of the powder mix can be tuned for various application methods by adjusting the liquid carrier. The body is then dried to remove the binder. Thereafter, pre-sintered or bisque fired endcaps 22, 24 are inserted into the arc tube body 12 to form an assembly and the assembly is sintered by firing for about one hour at 1880° C. in hydrogen.

In a preferred embodiment the body 12 is formed of PCA and the stripe 20 comprises a mixture of 60 volume % tungsten, 40 volume % alumina, and a removable carrier or binder of alcohol and cellulose. A cermet comprising molybdenum and alumina could also be used.

During the sintering operation the stripe 20 will sinter simultaneously into the arc tube body. After the sintering operation the body is filled with an arc generating and sustaining medium, as know in the art, and electrodes 16 and 18 are inserted and sealed therein to form the arc tube 10.

For test purposes samples of arc tubes with and without the internal conductive stripe were manufactured and filled with 300 Torr Argon. The electrical breakdown characteristics of the samples were measured using a high voltage generator and an oscilloscope. The arc tube without the starting stripe had a minimum breakdown voltage of 5.48 kV, the arc tube with the starting stripe had a minimum breakdown of 2.52 kV, less than half that of the standard arc tube.

Tests between arc tubes having starting stripes externally versus no stripes show a difference in breakdown voltage of 25% while the difference between no stripe and an internal stripe shows a breakdown differential of 55%. The former tests were performed on cylindrical arc tubes rated at 150 W and filled with 300 Torr Argon while the latter tests were performed on bulgy arc tubes, also rated at 150 W but filled with 90 Torr Argon; however, although the geometries were different, the data support the presumption that the starting aid on the inside of the arc tube will result in a lower breakdown voltage than a similar starting aid on the outside of the arc tube.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An arc tube for a high intensity discharge lamp comprising:

a translucent body formed from a high temperature material, the translucent body defining a discharge space and including spaced-apart electrodes;

an arc generating and sustaining medium within said discharge space; and a starting aid contained within said discharge space, said starting aid comprising an electrically conductive stripe formed from a mixture of an electrically conductive material and the high temperature material.

2. The arc tube of claim 1 wherein the high temperature material is alumina and said starting aid is comprised of a cermet selected from a group consisting of tungsten and alumina and molybdenum and alumina.

3. The arc tube of claim 2 wherein said starting aid is a cermet of tungsten and alumina and contains about 60 volume % tungsten and about 40 volume % alumina.

4. The arc tube of claim 1 wherein said translucent body is cylindrical.

5. The arc tube of claim 1 wherein said high temperature material is alumina.

6. An arc tube for a high intensity discharge lamp comprising:

a translucent body formed from a high temperature material, the translucent body defining a discharge space and including spaced-apart electrodes;

an arc generating and sustaining medium within said discharge space; and a starting aid contained within said discharge space, said starting aid comprising an electrically conductive stripe of a cermet selected from a group consisting of tungsten and alumina and molybdenum and alumina.

7. The arc tube of claim 6 wherein said starting aid is a cermet of tungsten and alumina and contains about 60 volume % tungsten and about 40 volume % alumina.

* * * * *